United States Patent [19]

Pape

[11] Patent Number: 4,778,358

[45] Date of Patent: Oct. 18, 1988

[54] FUEL INJECTION PUMP

[75] Inventor: Werner Pape, Jonage, France

[73] Assignee: Robert Bosch GmbH, Stuttgart, Fed. Rep. of Germany

[21] Appl. No.: 6,666

[22] PCT Filed: Mar. 29, 1986

[86] PCT No.: PCT/DE86/00132

§ 371 Date: Nov. 24, 1986

§ 102(e) Date: Nov. 24, 1986

[87] PCT Pub. No.: WO86/05843

PCT Pub. Date: Oct. 9, 1986

[30] Foreign Application Priority Data

Apr. 2, 1985 [DE] Fed. Rep. of Germany ..... 3512019

[51] Int. Cl.[4] ..... F04B 7/06; F02M 37/04

[52] U.S. Cl. ..... 417/500; 123/502; 417/289

[58] Field of Search ..... 123/502, 449, 549; 417/500, 218, 219, 212, 289

[56] References Cited

U.S. PATENT DOCUMENTS 4,168,690 9/1979 Hofer ..... 123/502

4,262,645 4/1981 Kobayashi ..... 123/502

FOREIGN PATENT DOCUMENTS 2942090 4/1981 Fed. Rep. of Germany ..... 91/497

47901 1/1979 Japan ..... 123/502

48001 1/1980 Japan ..... 123/502

48206 6/1982 Japan ..... 123/502

*Primary Examiner*—William L. Freeh

*Attorney, Agent, or Firm*—Michael J. Striker

[57] ABSTRACT

Fuel injection pump with a cam drive 3 effecting the feeding movement of a pump piston 1 which is provided with a rotating part 1,2 being rotationally connected with the pump piston 1 and a drive ring 21 for the pump drive being rotatable by about a certain angle for the purpose of starting the feeding change, whereby the rotating of the drive ring 21 is performed by an injection adjustment bolt 22 which radially penetrates the drive ring and which is pivotable by means of an injection adjustment piston 23 mounted tangentially to the drive ring 21, whereby the injection adjustment bolt 22 is provided with axial front faces 41,43 coacting in both axial directions with support faces 24,25 which are independent from the injection adjustment bolt for its axial securing.

9 Claims, 2 Drawing Sheets

FUEL INJECTION PUMP

BACKGROUND OF THE INVENTION

The invention is based on a fuel injection pump in accordance with the type of the main claim.

In a known fuel injection pump of this type (Bosch distributor injection pump VE Bosch technical instruction VDT-u 2/2 De) the injection adjustment bolt is secured against axial displacement by a pin which transversely penetrates the injection adjustment piston immersing into a bore of the drive ring, whereby the pin is protected against dropping out by means of a steel clamp which encompasses the injection adjustment piston.

This known type of axial securing of the injection adjustment piston is disadvantageous in that after inserting the bolt during assembly of the injection pump one must mount the safety pin and the clamp requiring two operating steps, whereby the injection adjustment piston must be brought into the turning position in which the bore receiving the safety pin is in a superimposed position with the associated bore in the drive ring. Moreover, each additional operating step or each additional structural part, like the safety pin and the sheet metal clamp, disadvantageously require an additional manufacturing control irrespective of the additional material and finishing expenses for these parts. Since such fuel injection pumps are made in great numbers, the aforementioned disadvantages are accordingly serious.

A substantial disadvantage of this known fixing of the injection adjustment bolt consists in that the injection adjustment bolt is prevented from rotating around its own axis because of the safety pin. Thereby, engagement faces develop one sided wear with respect to the drive ring and with respect to the injection adjustment piston due to the stress. Thus, when running, wear deviations result from the actual value to the rated value of the start of the feeding, which may result in a critical running or even a damaging of the internal combustion engine which is supplied by the injection pump.

SUMMARY OF THE INVENTION

In contrast thereto, the fuel injection pump in accordance with the invention and the characterizing features of the main claim is advantageous in that the injection adjustment bolt is secured in view of its position against an axial displacement after being assembled, so that no additional safety elements or finishing operations are required. In addition so material saving and very simplified assembly, additional possible error sources are also eliminated and the operating or finishing control is simplified. Since the injection adjustment piston can rotate around its axis, a substantially uniform wear is performed and thereby an increase in the control precision of this feeding start device.

This invention is preferably usable in distributor injection pumps. Therein either the pump pistons are driven radially with respect to the distributor, shaft by means of a drive ring in the form of a cam ring, or wherein only a single pump piston is provided which is actuated into a reciprocating movement by means of a cam disk which runs on rollers and which is simultaneously rotated by a drive shaft.

In accordance with an advantageous embodiment of the invention, a corresponding ring segment of the jacket face of the rotating part is used as a support face in the direction of the axis of the drive ring. The fuel injection pump may be provided with a rotating pump piston as a distributor and a dog clutch between the pump piston and a rotating drive shaft. This ring face is provided at the end segment of the drive shaft facing the pump piston. Since the rotating part is hardened in the area of the ring segment and since the complete cam drive is immersed in Diesel oil, a very simple, effective and wear resistant securing is obtained in one of his axial direction for the injection adjustment bolts.

As a securing in the opposite direction a plurality of variants are possible in accordance with the invention. A rotatably guided slide ring is mounted in a transverse opening of the injection adjustment piston which is provided with a transverse bore for receiving the facing end segment of the injection adjustment bolt, as in the aforementioned known fuel injection pump. In accordance with one variant, the end segment of the injection adjustment bolt is provided with a finished off portion which corresponds to the diameter of the transverse bore. The radial, annular like front face formed by the finished off portion coacts with a support face being provided on the slide ring. A flat portion of the slide ring in the area of the orifice of the transverse bore is used as a support face. Since a displacement in axial direction of the injection adjustment bolt is not possible because of a rotating position of the slide ring in the injection adjustment piston, a displacement securing is obtained in the direction of the injection adjustment piston in a very simple manner. Since the injection adjustment piston is provided tangentially with respect to the drive ring, a certain distance change is obtained between the drive ring and slide ring during the injection adjustment piston movement which is so small that it is not disadvantageous for the axial guiding of the injection adjustment bolt.

In accordance with another variant of the invention the transverse bore in the slide ring is formed as a pocket bore, whose base face is used as the support face for the front face end face of the injection adjustment bolt cooperating therewith. In this variant the injection adjustment bolt may be formed as a smooth cylinder bolt.

In accordance with a further variant, wherein the injection adjustment piston is guided in a cylinder bore, the injection adjustment bolt penetrates the injection adjustment piston and coacts with its preferably polished front face with the wall of the cylinder bore which is used as a support face. In this case the injection adjustment piston will be mostly equipped with a slide ring. Here too, the particular advantage consists in that the injection adjustment bolt is formed as a smooth cylindrical part.

In accordance with a further variant of the invention the injection adjustment bolt is again formed as a step bolt, whose step is provided in the wide range of the drive ring and whose front ring face coacts with a support face on the drive ring in the direction to the axis of the drive ring. During use in the aforementioned known fuel injection pump, the drive ring is formed as a roller ring having a U-shaped cross section and supporting rollers, and cooperating with a stroke cam disk connected with the pump piston. The front ring face of the injection adjustment bolt supports inside on the outer of the two U-shaped shank rings. In this variant, the play of the axial guidance of the injection adjustment bolt may kept very small. In the specific embodiment, only the bore which is penetrated by the injection adjustment bolt and which is positioned closer to the axis of the roller ring must be correspondingly larger in its diamter than the one which is positioned further away.

Further advantages and embodiments of the invention can be seen from the subsequent description, the drawing and the claims.

BRIEF DESCRIPTION OF THE DRAWINGS

One exemplified embodiment of the subject matter of the invention is illustrated with a plurality of variants in the drawing and is described in more detail in the following.

DESCRIPTION OF THE PREFERRED EMBODIMENT

Figure 1:
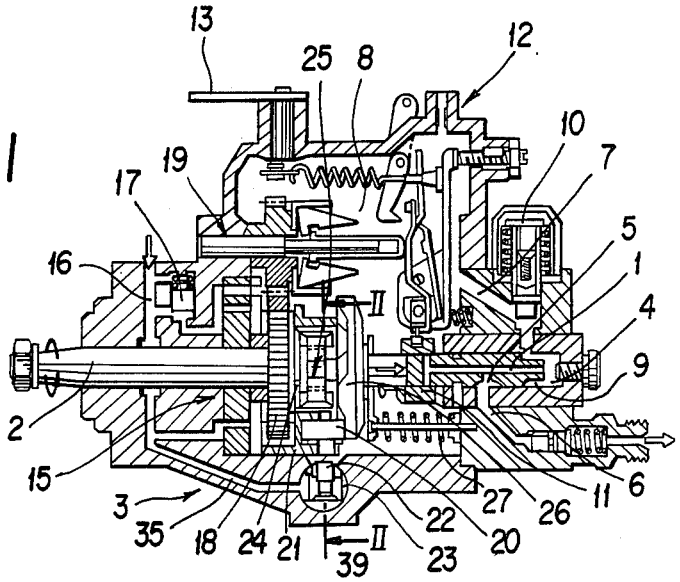
FIG. 1 illustrates a fuel injection pump in accordance with the invention in a longitudinal cross-section and FIGS. 2 to 5 illustrates four different variants in accordance with a cross-section taken across section with line II—II in FIG. 1 in an enlarged scale.

A distributor injection pump is illustrated in FIG. 1 in a longitudinal cross-section, wherein a pump and distributor piston 1 is driven by a drive shaft and, with the assistance of a cam drive, in a reciprocating movement and simultaneously in a rotating movement. Thereby, during each pressure stroke of the pump piston 1, fuel is fed from a pump operating chamber 4 through a distribution groove 5 to one of a plurality of pressure conduits 6, which are mounted around the pump and distributor piston 1 and which lead to a cylinder of the internal combustion engine to be supplied. The pump operating chamber 4 is supplied with fuel through a suction conduit 7 from a suction chamber 8 mounted in the housing of the injection pump during the suction stroke of the pump piston 1. During this suction stroke the connection between suction conduit 7 and the pump operating chamber 4 is controlled by longitudinal control grooves 9 in pump piston 1. A magnetic valve 10 is provided in the suction conduit 7 closes suction conduit 7 for completing the injection. The amount to be injected per stroke is defined by the axial position of a control slide 11 which is mounted around the pump piston 1, whose position is changed by evaluating the load and speed by means of a speed regulating device 12 and an adjustment lever 13 which can be arbitrarily actuated.

The drive shaft 2 drives a feeding pump 15 which is supplied with fuel through a suction line 16 and fed into the suction chamber 8 of the injection pump. The fuel pressure in suction chamber 8 is maintained at a height which increases with speed by means of a pressure control valve 17. The drive shaft 2 drives a tachometer 19, being provided with centrifugal weights, of the speed regulating device 12 by means of a gear 18.

The cam drive 3 is provided with a drive ring 21 which supports rollers 20 and is mounted in the housing. The drive ring has a U-shaped cross section and is adjustable around a certain angle means of an injection adjustment bolt 22 by and an injection adjustment piston 23. The power output end of drive shaft 2 extends into the inner bore 24 of this drive ring 21 and forms a claw clutch 25 together with the end of the pump piston 1 facing the same which provides a rotating connection between the drive shaft 2 and the pump piston 1, thus enabling a stroke movement of the pump piston 1 which is independent of drive shaft 2. A front cam disk 26 is rigidly connected with pump piston 1 which rolls with its cam front face on drive rollers 20 during the rotation of drive shaft 2 and pump piston 1 for its stroke drive. Thereby, it is pressed with its running path onto the rollers 20 by means of springs 27, of which only one is illustrated.

The injection adjustment piston 23 is guided in a cylinder bore 30 tangentially with respect to the drive ring 21, whereby the fuel, whose pressure is dependent on the speed, flows from the suction chamber 8 of the injection pump through a conduit 31 of the injection adjustment piston 23 and into a chamber 32 on the one front face of the injection adjustment piston 23. The injection adjustment piston 23 is loaded by a return spring 33 (FIG. 2) on the side facing away from chamber 32. The chamber 34 which receives the return spring 33 is relieved of pressure by means of a return conduit 35 to the suction line 16 (FIG. 1). When the fuel pressure increases with increasing speed in suction chamber 8, the injection adjustment piston 23 is displaced against the force of this spring and drive ring 21 undergoes a corresponding turning, whereby the drive rollers 20 come into contact the cams of the front cam disk 26 somewhat earlier and therefore initiate the start of the stroke of pump piston 1 and the start of the higher feeding process earlier in time. Therefore, the the speed, the earlier is the beginning of delivery.

The injection adjustment bolt 22, which is used for transmitting the stroke movement of the injection adjustment piston 23 for a turning movement of the driving ring 21, is fixed in its axial position. In FIGS. 2 to 5 four variants of the inventive fixing are illustrated. The end of the injection adjustment piston 23 facing the injection adjustment bolt 22 penetrates the drive ring 21 while guided in two coaxial bores 37 and 38 which penetrate the outer U-shaped shank 36*a* and the inner U-shaped shank 36*b*. The piston 23 is received with its other end by a slide ring 39 which is guided in a corresponding recess 40 which formed as a transverse bore in injection adjustment piston 23.

In all variants, the front face 41 of the injection adjustment piston bolt 22 facing the pump axis is supported for its axial securing in this direction, on the annular ring face facing the same of the power output end 24 on the drive side 2. Even if this support face positioned opposite the front face 41 consisted of a plurality face segments of the claw clutch, the total axial ring face is so smooth due to the accurate manufacturing that no danger of roughness exists.

Figure 2:
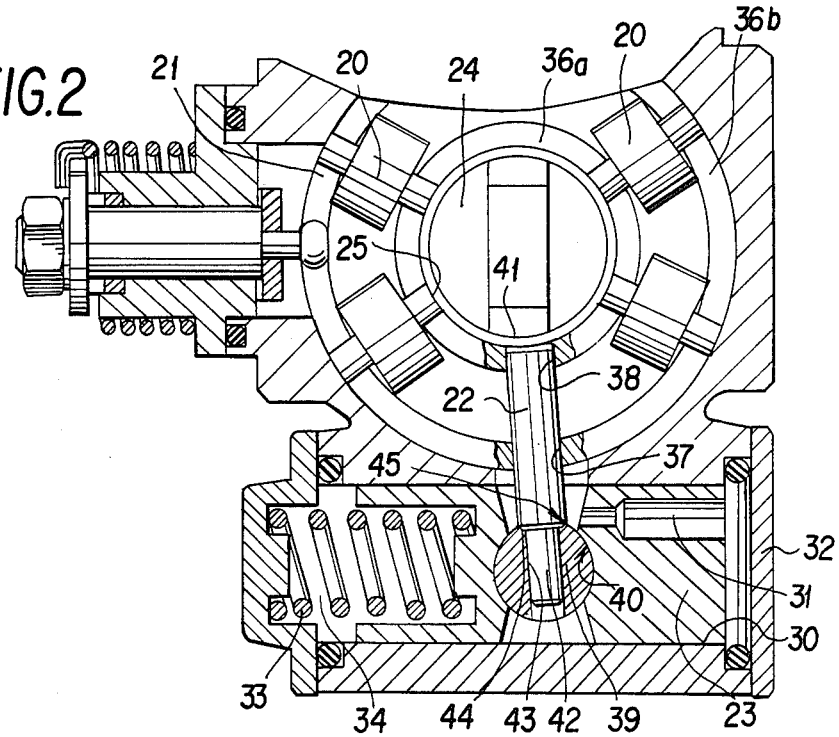

In the first variant illustrated in FIG. 2 the slide ring 39 is used as the axial securing for the injection adjustment piston 22. The injection adjustment 22 is provided with a finished portion 22 of the segment in this variant which immerses into the bore 43 of the slide ring 39. The annular shoulder 44 which is formed by this finished portion 42 supports on a support face 45 which is present by a corresponding flattening of the slide ring 39. Due to the guiding of the slide ring 39 in the transverse bore it can be used as an axial abutment for the injection adjustment bolt 22.

Figure 3:
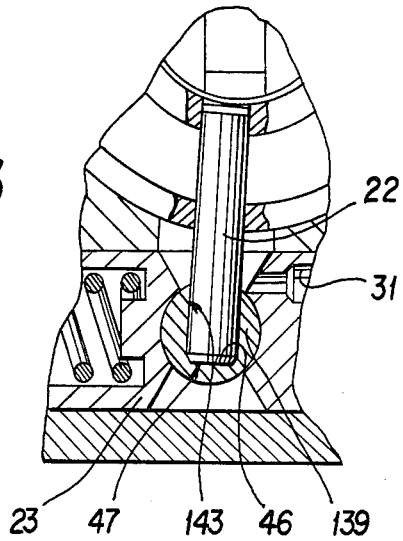

In the second variant illustrated in FIG. 3 the bore 143 which receives the end of the injection adjustment bolt 22 is formed as a pocket bore in slide ring 139. The bottom 46 of this pocket bore 143 is used as a support face for the front face 47 of the injection adjustment bolt 22, so that an axial securing is providing in this direction. The injection adjustment bolt 22 is formed as a smooth cylindrical part.

Figure 4:
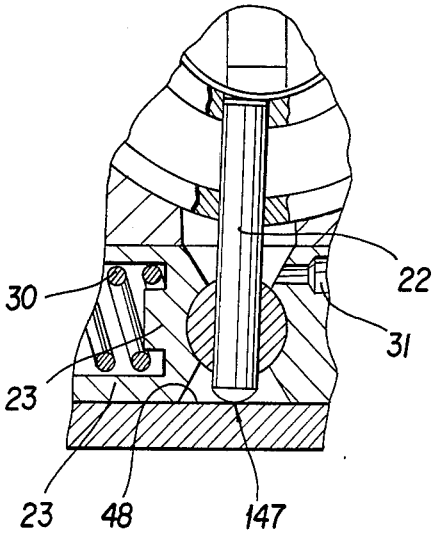

In the third variant which is illustrated in FIG. 4, the injection adjustment bolt 22 is formed as a smooth cylindrical part. However, in addition it is extended to the cylinder wall 48 of bore 30 which is used as the support wall and in which the injection adjustment piston 23 is guided. The front face 147 of the injection adjustment piston 22 facing the support wall 48 is rounded off and polished, so as to minimize the friction forces. Moreover, these are hardened parts on which these contact faces are provided.

Figure 5:
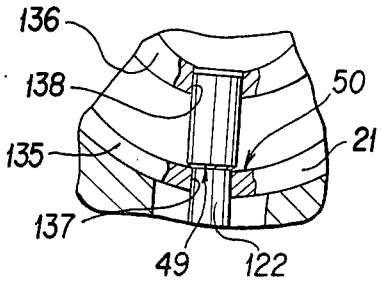

In the fourth variant of the exemplified embodiment illustrated in FIG. 5 the injection adjustment bolt 122 is already secured against an outward displacement in the drive ring 21. For this purpose the injection adjustment bolt 122 is provided with a step with a front ring face 49 in the area of the drive ring 21 which supports on a support face 50 on the inner side of the outer shank ring 135. Corresponding to the diameters of the injection adjustment bolt 122 the bores 137 and 138 are different in the U-shaped shank ring 136 and the outer U-shaped shank ring 135.

I claim:

1. A fuel injector pump comprising:

a housing;

means for feeding a fuel to be injected and including at least one pump piston having an axis and being reciprocably movable along said axis in said housing and having a pressure stroke during which the fuel is fed;

cam drive means for driving said feeding means and having at least one rotary element having an axis and means rotatably connecting said piston and said rotary element, said rotatably connecting means including at least one drive ring coaxially mounted with respect to said rotary element, said drive ring having an axis and being formed so as to be rotatable to displace tangentially, said drive ring and said piston being formed so that when said drive ring is displaced in one tangential direction by rotating, said piston starts said pressure stroke earlier than would occur otherwise if said drive ring had not been rotated in said one tangential direction;

means for changing a time in which to start said piston pressure stroke to thereby change a time in which to start said pump piston feeding the fuel and including means for rotating said drive ring about said drive ring axis by a predetermined angle to displace said drive ring tangentially, said means for rotating including an elongated injection adjustment bolt member and an injection adjustment piston member, said bolt member having a bolt axis and two axial ends facing outward away from each other, said injection adjustment piston member being axially displaceable, said bolt member being arranged to tangentially displace said drive ring in association with an axial displacement of said injection adjustment piston member;

means for axially securing said bolt member against axial movement and including two support surfaces cooperating with said two axial ends of said bolt member to axially secure said bolt member therebetween, said support surfaces extending transversely relative to said bolt axis and being arranged independent of said bolt member and said drive ring, said rotary element having a ring-shaped end portion in said housing, said ring-shaped end portion having an outer surface constituting one of said two support surfaces; and means for rotatably connecting said ring portion of said rotary element with said drive ring and including at least one claw clutch therebetween in contact with both of said ring portion of said rotary element and said drive ring, said bolt member penetrating said drive ring entirely so that said drive ring guides said bolt member into contact with said support surfaces.

2. The fuel injection pump as defined in claim 1, wherein said said axially securing means includes means for preventing outward displacement of said injection adjustment bolt member and including said bolt member having a stepped portion so as to form a step bolt, said stepped portion being arranged radially inside of said drive ring, said stepped portion having a face transverse of said axis of said bolt member, said drive ring having a surface facing said drive ring axis, said drive ring surface cooperating with said stepped face to prevent outward displacement of said injection adjustment bolt.

3. The fuel injection pump as defined in claim 1, wherein said turning means includes at least one roller and also a stroke cam disc connected with said pump piston, said drive ring being formed as a roller ring with a U-shaped cross-section, said roller ring supporting said at least one roller, said at least one roller together with said drive ring cooperating with said stroke cam disc for said turning.

4. The fuel injection pump as defined in claim 1, wherein said transmission means includes another said drive ring, said drive rings having a U-shaped cross-section and arranged and formed so that one of said drive rings is radially inside of the other thereby constituting inner and outer rings, said injection adjustment bolt member having a surface formed supporting said outer ring from inside.

5. The fuel injection pump as defined in claim 1, wherein said injection adjustment piston member is formed with an axis and an opening extending transversely relative to said piston member axis, said injection adjustment bolt member being formed with an end portion extending from one of said axial ends; and further comprising:

means for receiving said one axial end of said injection adjustment bolt element in said opening and including a slide ring rotatably guided in said opening, said slide ring forming a transverse bore therein accomodating said one axial end, said transverse bore being formed as a pocket bore having a bottom face, said axially securing means including said bottom face cooperating with said one axial end, said bottom face constituting one of said supporting surfaces.

6. The fuel injection pump as defined in claim 1, wherein said injection adjustment piston member is formed with an axis and an opening extending transversely relative to said piston member axis, said injection adjustment bolt member being formed with an end portion extending from one of said axial ends and an adjacent portion adjacent to said end portion, said end portion having a cross-section smaller than said adjacent portion so as to form a shoulder facing transverse of said bolt axis; and further comprising:

means for receiving said end portion of said injection adjustment bolt element in said opening and including a slide ring rotatably guided in said opening, said slide ring forming a transverse bore therein accomodating said end portion, said axially securing means including said slide ring having a side surface cooperating with said shoulder to axially secure said injection bolt member.

7. The fuel injection pump as defined in claim 6, wherein said transverse bore of said slide ring has a flattened portion, said axially securing means including said flattened portion cooperating with one of said axial ends to axially secure said injection adjustment bolt member, said flattened portion constituting one of said support surfaces.

8. The fuel injection pump as defined in claim 1, wherein said turning means includes guiding means for guiding said injection adjustment piston member to displace axially, said guiding means having a wall facing said injection adjustment piston member and along which said piston member is axially displaceable, said injection adjustment bolt member penetrating said injection adjustment piston member, said axially securing means including one of said axial ends cooperating with said wall to axially secure said injection adjustment bolt member, said wall constituting one of said support surfaces.

9. The fuel injection pump as defined in claim 8, wherein said one axial end is polished.

* * * * *